US007637036B2

(12) United States Patent
Sellers et al.

(10) Patent No.: US 7,637,036 B2
(45) Date of Patent: Dec. 29, 2009

(54) DETACHABLE SOLE FOR AN ANKLE AND FOOT COVERING

(75) Inventors: David R. Sellers, 3305 County Road 96, Ward, CO (US) 80481; Kurt Botsai, Thousand Oaks, CA (US); Ravi K. Sawhney, Calabasas, CA (US); Craig R. Steele, Los Angeles, CA (US); Lance G. Hussey, Simi Valley, CA (US); Robb Englin, Los Angeles, CA (US); Simon Risley, Ventura, CA (US)

(73) Assignee: David R. Sellers, Ward, CO (US)

( * ) Notice: Subject to any disclaimer, the term of this patent is extended or adjusted under 35 U.S.C. 154(b) by 498 days.

(21) Appl. No.: 11/189,204

(22) Filed: Jul. 25, 2005

(65) Prior Publication Data

US 2006/0196085 A1 Sep. 7, 2006

Related U.S. Application Data

(60) Provisional application No. 60/659,991, filed on Mar. 7, 2005.

(51) Int. Cl.
*A43B 13/00* (2006.01)
*A43C 13/02* (2006.01)

(52) U.S. Cl. ..... 36/103; 36/15; 36/132; 36/117.4

(58) Field of Classification Search ..... 36/7.5, 36/7.6, 117.4, 117.3, 132, 135, 37, 103, 123, 36/106; D2/914
See application file for complete search history.

(56) References Cited

U.S. PATENT DOCUMENTS 995,245 A * 6/1911 Futterknecht ..... 36/73
3,964,761 A 6/1976 Syrovatka
3,965,586 A 6/1976 Roosli
3,971,144 A 7/1976 Brugger-Stuker
4,123,854 A 11/1978 Pasich
D250,796 S 1/1979 DeFever
4,156,316 A 5/1979 DeFever
4,160,301 A * 7/1979 Woolley ..... 12/120.5
4,199,880 A * 4/1980 Frey ..... 36/132
4,228,602 A 10/1980 Groves
4,269,430 A 5/1981 Eie
4,286,397 A 9/1981 Booty
4,291,473 A 9/1981 Sartor
D263,516 S 3/1982 Booty (Continued)

*Primary Examiner*—Jila M Mohandesi
(74) *Attorney, Agent, or Firm*—Daniel P. Dooley; Fellers, Snider, et al.

(57) ABSTRACT

A combination and methods of making and using the combination are disclosed. Preferably the combination includes at least: an ankle and foot covering; a detachable sole detachably attached to the ankle and foot covering; and a detachable sole storage rack attached to the ankle and foot covering for use in storing the detachable sole when detached from the ankle and foot covering. The detachable sole preferably includes at least: heel and toe chassis portions each formed from a baffled support matrix and overmolded with tread portions; and an over-center latch coupled to an attachment hoop. The over-center latch preferably incorporates adjustment features to accommodate varying sizes of the ankle and foot coverings. Upon latching of a properly adjusted over-center latch adjacent the ankle and foot covering, a holding force transmitted through the attachment hoop secures the detachable sole adjacent the ankle and foot covering.

16 Claims, 11 Drawing Sheets

U.S. PATENT DOCUMENTS 4,403,789 A 9/1983 Hickey
4,461,104 A * 7/1984 Calkin et al. ..... 36/132
D277,899 S 3/1985 Hutchinson
4,505,057 A 3/1985 Kiester
4,542,599 A * 9/1985 Annovi ..... 36/117.4
4,727,662 A 3/1988 Ilon
4,774,775 A 10/1988 Pruitt
4,843,672 A 7/1989 Fasse
4,958,445 A 9/1990 Brisco
5,283,963 A * 2/1994 Lerner et al. ..... 36/28
5,313,717 A * 5/1994 Allen et al. ..... 36/28
5,369,896 A * 12/1994 Frachey et al. ..... 36/29
5,569,173 A 10/1996 Varn
5,649,374 A * 7/1997 Chou ..... 36/27
5,746,016 A 5/1998 Freisinger et al.
5,815,953 A 10/1998 Kaufman et al.
5,891,067 A 4/1999 Reed
5,961,477 A 10/1999 Turtzo
6,044,578 A 4/2000 Kelz
6,277,087 B1 8/2001 Hess et al.
6,301,804 B1 10/2001 Battaglia
6,361,514 B1 3/2002 Brown et al.
6,402,183 B1 * 6/2002 Marmonier et al. ..... 280/613
6,421,935 B1 7/2002 Bartlett
6,481,121 B1 11/2002 Tucker
6,523,280 B1 2/2003 Lapointe
6,857,202 B2 * 2/2005 Pfander ..... 36/3 R
2002/0189133 A1 12/2002 Parisotto et al.

* cited by examiner

DETACHABLE SOLE FOR AN ANKLE AND FOOT COVERING

RELATED APPLICATIONS

This application claims priority to U.S. Provisional Application No. 60/659,991 filed Mar. 7, 2005, entitled SKI BOOT ATTACHMENTS.

FIELD OF THE INVENTION

This invention relates to detachable soles for ankle and foot coverings, which afford easier walking for individuals wearing ankle and foot coverings, and more particularly, but not by way of limitation, to attachments that easily attach and detach to the bottoms of ski boots, and to the bottom of an orthopedic device affixed to an individual's ankle and foot.

BACKGROUND

Walking in orthopedic devices or ski boots is an awkward endeavor at best. Attachments that fit onto the bottom of ski boots and orthopedic devices have been proposed in the prior art. However, each proposed solution has drawbacks, which fail to provide: an overall solution to ease the process of walking in ski boots or orthopedic devices when encountering changes in the walking terrain; and a convenient, compact configuration for storing the attachment when not in use.

As such, challenges remain and a need persists for improvements in methods and apparatuses for use in enhancing the walking experience of individuals wearing ski boots or orthopedic devices.

BRIEF SUMMARY OF THE INVENTION

In accordance with preferred embodiments, a combination including: an ankle and foot covering; a detachable sole configured for attachment to and detachment from the ankle and foot covering; a detachable sole storage rack configured for attachment to the ankle and foot covering and for receipt of the detachable sole, when the detachable sole is detached from the ankle and foot covering; and methods of making and using the combination are provided.

In a preferred embodiment, the detachable sole includes at least a chassis that provides a baffled support matrix interposed between top and bottom chassis portions, and more preferably the chassis includes a hinge interposed between a heel chassis portion and a toe chassis portion, in which said heel and toe chassis portions each comprise baffled support matrices interposed between top and bottom chassis portions to form the chassis.

Preferably, the toe chassis portion is overmolded with a toe tread portion to form a first sole portion, and the heel chassis portion is overmolded with a heel tread portion to form a second sole portion, and the hinge includes at least one hinge knuckle and a pair of hinge pins. Preferably, each hinge knuckle provides a pair of hinge pin apertures, and the hinge pins are configured for sliding engagement with the hinge pin apertures.

The detachable sole further preferably includes an attachment hoop that communicates with a heel chassis, and a latch attached to the attachment hoop, such that upon a positioning of the latch adjacent a latch region of the ankle and foot covering and latching the latch, the detachable sole is attached to the ankle and foot covering. Preferably, the attachment hoop is attached to the heel chassis portion by a latch pin. The heel chassis portion preferably provides a latch pin mounting aperture, which includes an inner diameter configured to provide an interference fit between the latch pin and the mounting aperture, when the latch pin engages the inner diameter of the latch pin mounting aperture.

In a preferred embodiment, the latch is preferably an over-center latch that includes at least a latch block with a latch body engagement feature and a latch door engagement feature, a latch body configured for engagement with the latch block, and a latch door configured for engagement with the latch body and latch block.

A preferred embodiment of the present intention further includes a plurality of side caps configured to prevent encroachment of debris from entering the baffled support matrices of the toe and heel chassis portions, and mounting studs provided by the detachable sole storage rack to confine the detachable sole in proper alignment with the detachable sole storage rack, wherein the detachable sole is detached from the ankle and foot covering. In addition to the mounting studs, the detachable sole storage rack further preferably provides a strap used to secure the detachable sole to the detachable sole rack when storing the detachable sole.

These and various other features and advantages that characterize the claimed invention will be apparent upon reading the following detailed description and upon review of the associated drawings.

DETAILED DESCRIPTION

Reference will now be made in detail to one or more examples of the invention depicted in the figures. Each example is provided by way of explanation of the invention, and not meant as a limitation of the invention. For example, features illustrated or described as part of one embodiment may be used with another embodiment to yield still a different embodiment. Other modifications and variations to the described embodiments are also contemplated within the scope and spirit of the invention.

Figure 1:
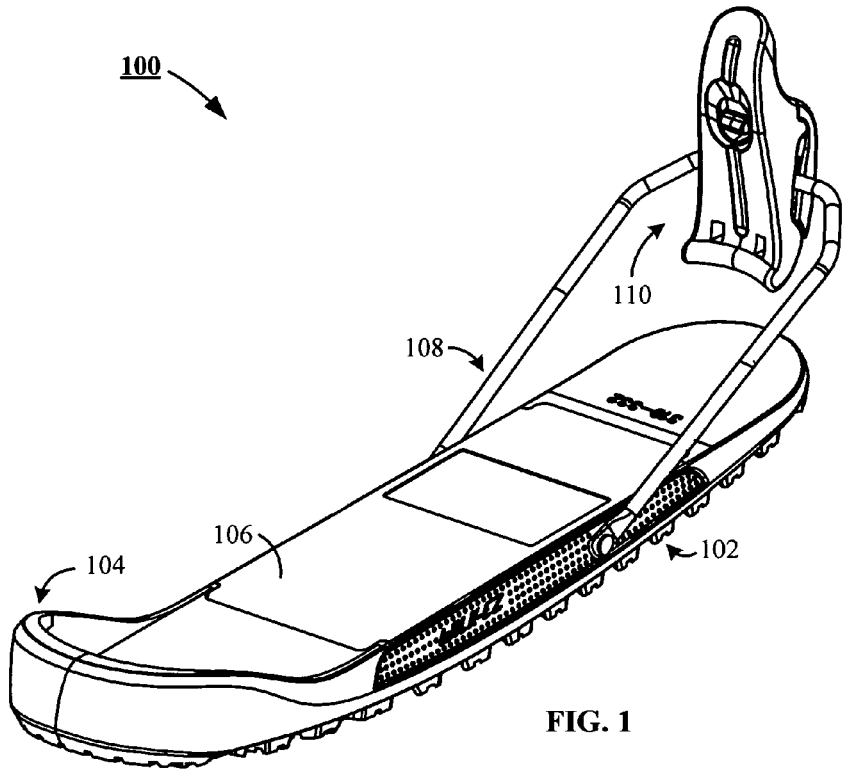
FIG. 1 shows a top perspective view of an embodiment of an inventive detachable sole.

Referring to the drawings, FIG. 1 shows an inventive detachable sole 100 that includes a tread portion 102, which includes a toe confinement portion 104, attached to a chassis 106. In a preferred embodiment, the tread portion 102 is attached to the chassis 106 through the use of an overmold process. However, alternate techniques may be used for the attachment of the tread portion 102 to the chassis 106, such as through the employment of adhesive material, or by sonically welding the components together.

In a preferred embodiment, the chassis 106 is formed from glass filled polypropylene compound, in which the compound contains between 10-30% glass by volume, and preferably 20% glass by volume, and the tread portion 102 preferably formed from a quasi pliable polymer such as the thermoplastic elastimer resin (TPE), or a polyurethane.

FIG. 1 further shows the inventive detachable sole 100 further includes an attachment hoop 108, which is preferably formed from nickel plated steel, but may be formed from alternate materials such as a carbon filed compound, or stainless steel. In a preferred embodiment, the attachment hoop 108 supports a latch 110, that is preferably an over-center latch. The latch 110 accommodates attachment of the detachable sole 100 to a plurality of ankle and foot coverings.

Figure 2:
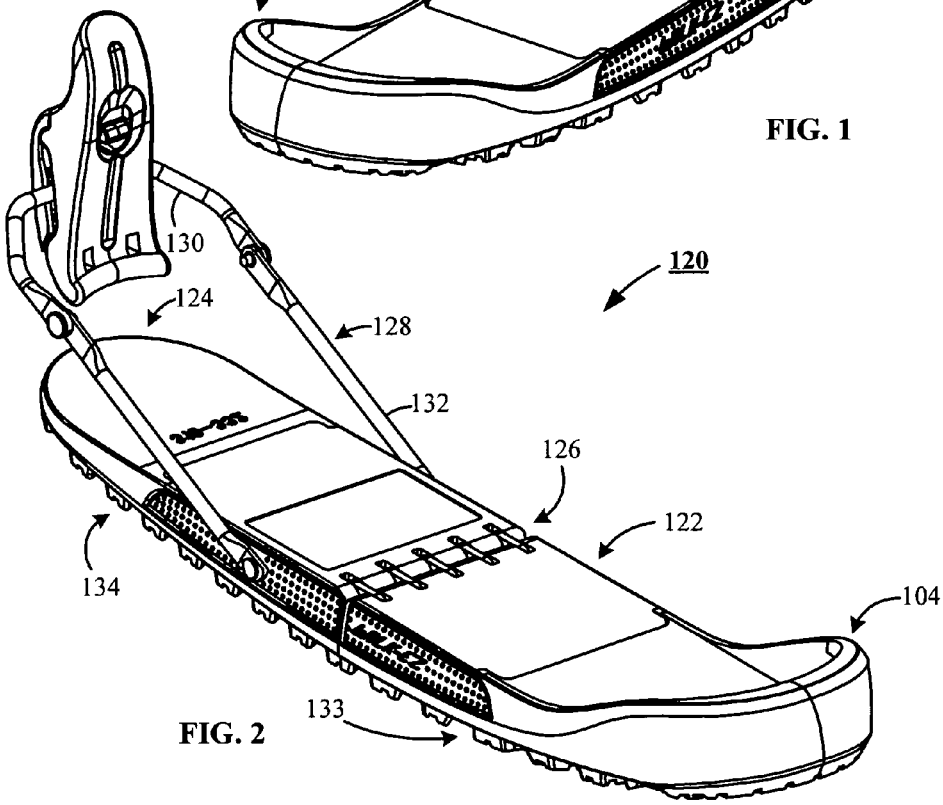
FIG. 2 shows a top perspective view of an alternate embodiment of the inventive detachable sole.

Turning to FIG. 2, shown therein is an alternate preferred embodiment of the inventive detachable sole 120. In contrast to the detachable sole 100 (of FIG. 1), the detachable sole 120 includes a first sole portion 122 and a second sole portion 124 secured together by a hinge portion 126. Additionally, the attachment hoop 108 (of FIG. 1) of the detachable sole 100 differs from an attachment hoop 128 of the inventive detachable sole 120. The attachment hoop 128 provides two portions, a latch attachment portion 130 and a heel chassis attachment portion 132 hinged to the latch attachment portion 130. It is noted however that the inventive detachable sole 120 and the inventive detachable sole 100 share the latch 110 in common.

Figure 3:
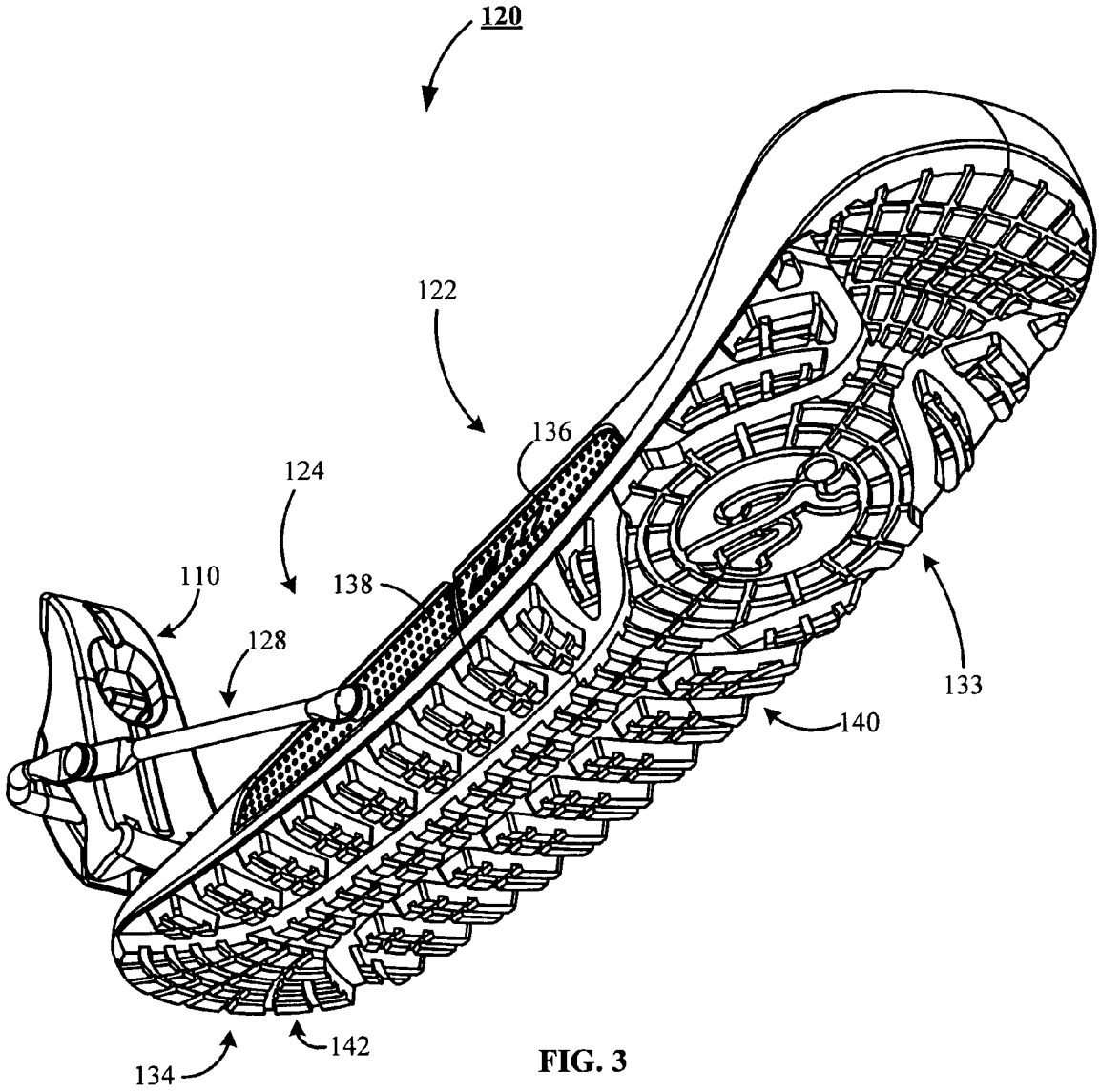
FIG. 3 is a bottom perspective view of tread portions of the inventive detachable sole of FIG. 2.

FIG. 3 shows the first sole portion 122 includes a toe tread portion 133, and the second sole portion 124 includes a heel tread portion 134. As with the tread portion 102 (of FIG. 1), the toe and heel tread portions 133,134 are preferably attached through the use of an overmold process. FIG. 3 further shows that the first sole portion 122 includes a side cap 136, and the second sole portion 124 includes a side cap 138. It will be understood that a tread pattern 140 of the toe tread portion 133, and a tread pattern 142 of the heel tread portion 134 represent preferred tread patterns, and do not impose limitations on the present invention. Those skilled in the art understand that alternate tread patterns may be utilized, and slip resistance mechanisms such as studs (similar to studs used on studded snow tires) may be incorporated within tread patterns 140 and 142, which fall within the scope of the present invention.

Figure 4:
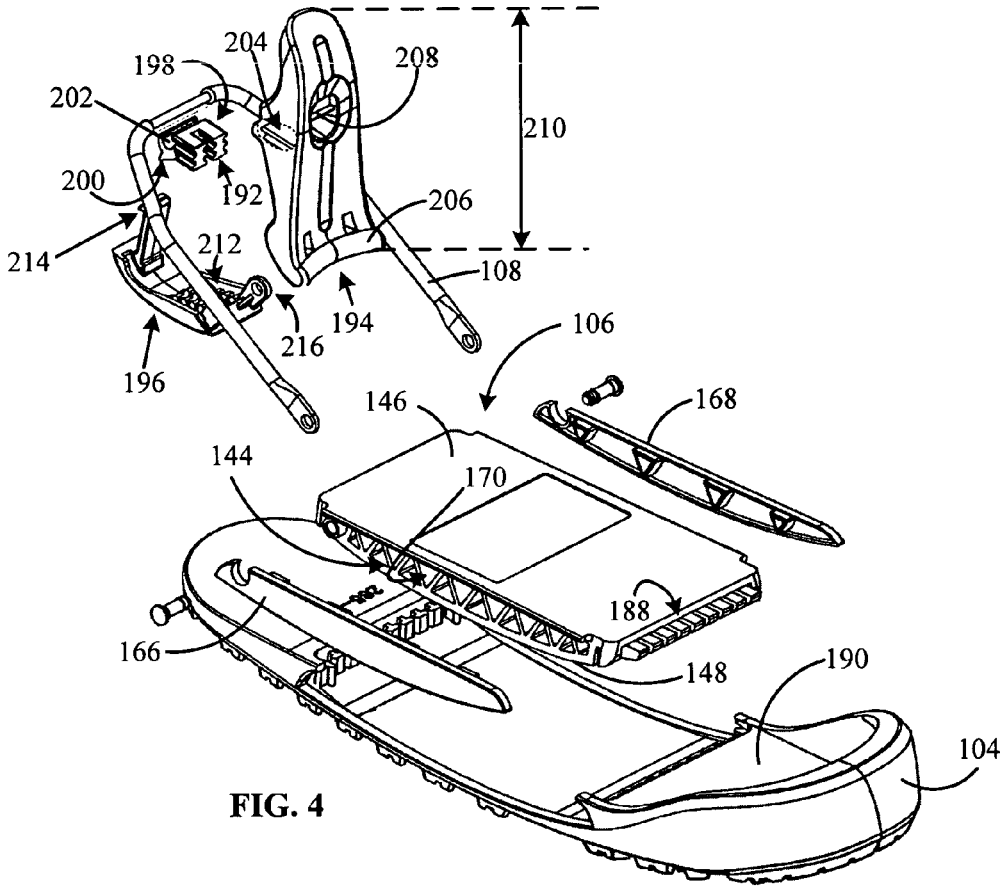
FIG. 4 is an exploded perspective view of the inventive detachable sole of FIG. 1.
Figure 5:
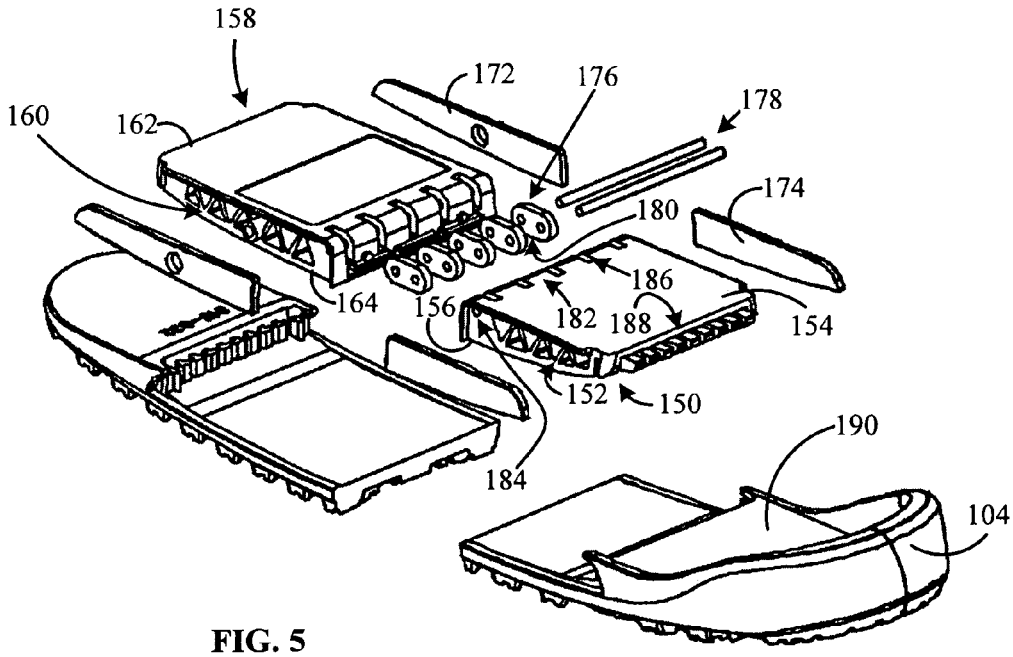
FIG. 5 is an exploded perspective view of the inventive detachable sole of FIG. 2.

The exploded perspective views of the inventive detachable soles 100 and 120 of FIG. 4 and FIG. 5 respectively may be best viewed in concert to provide an enhanced understanding of the commonalities and differences between the inventive detachable soles 100 and 120.

FIG. 4 shows chassis 106 includes a baffled support matrix 144 interposed between a top chassis portion 146 and a bottom chassis portion 148. FIG. 5 shows that the first sole portion 122 includes a toe chassis portion 150 constructed with a baffled support matrix 152 interposed between a top chassis portion 154 and a bottom chassis portion 156. The second sole portion 124 includes a heel chassis portion 158 constructed with a baffled support matrix 160 interposed between a top chassis portion 162 and a bottom chassis portion 164.

FIG. 4 shows the inventive detachable sole 100 includes a right side cap 166 and a left side cap 168. When the side caps 166 and 168 are attached to the baffled support matrix 144, debris is prevented from entering a plurality of cavities 170. It is noted that the plurality of cavities 170 collectively form the baffling members of the baffled support matrix 144. In addition to the side caps 136 and 138 (of FIG. 3), FIG. 5 further shows the inventive detachable sole 120 includes a pair of the left side caps 172 and 174, which are provided to preclude entry of debris into the baffled support matrix 152.

The hinge portion 126, as shown by FIG. 5, includes a plurality of hinge knuckles 176, and a pair of hinge pins 178. Each hinge knuckle 176 provides a pair of hinge pin apertures 180, and each hinge pin 178 is configured for sliding engagement within the hinge pin apertures 180. To accommodate each hinge knuckle 176, the toe chassis portion 150, and the heel chassis portion 158 each provide a plurality of hinge pin confinement portions 182, wherein each hinge pin confinement portions provides a passageway 184 sized to snugly accommodate each hinge pin 178 in mating contact. Interposed between each hinge pin confinement portions 182 are hinge knuckle reception cavities 186. Each hinge knuckle reception cavities 186 of the toe chassis portion 150 is positioned to align directly across from a corresponding hinge knuckle reception cavity 186 of the heel chassis portion 158.

When each the toe and heel chassis portions, 150,158 are outlined for mating with the hinge portion 126, each of the plurality of hinge knuckles are deposited within the hinge knuckle reception cavities 186, and each hinge pin is encouraged through the respective passageways 184 of the toe and heel chassis portions 150, 158 to combine the first sole portion 122 with the second sole portion 124 to form the inventive detachable sole 120.

As can be seen in FIG. 4, the chassis 106 includes a plurality of overmold interface cavities 188, which have been found useful in enhancing an ability of the tread portion 102 to adhere to the chassis 106. Preferably, during an overmold process, a selected polymer used in forming the tread portion 102 is forced through each of the overmold interface cavities 188, and reflowed together to form a continuous surface 190 adjacent to top chassis portion 146. The continuous surface 190 provides a bridge-way between the chassis 106 and the toe confinement portion 104. A quasi pliable polymer such as the thermoplastic elastimer resin (TPE), or a polyurethane is preferable for use in forming the tread portion 102, the continuous surface 190, and the toe confinement portion 104 because the selection of a quasi pliable polymer accommodates various toe configurations of a mating ankle and foot covering, such as a ski boot 220 (of FIG. 7). In a preferred embodiment, the quasi pliable polymer continuous surface 190, and the toe confinement portion 104 have been found useful in holding the inventive detachable sole 120 under tension when attached to the ski boot 220. However, as those skilled in the art will recognize, alternate methods of providing a tensile load to the detachable sole 120 to aid in maintaining a snug fit between the ski boot 220 and the inventive detachable sole 120 may be provided, without deviation from the scope and spirit of the present invention, for example, through use of a spring configuration.

The latch 110 of FIG. 4, which in a preferred embodiment is an over-center latch 110 that includes three primary components: a latch block 192, a latch body 194, and a latch door 196. The latch block 192 provides a latch body engagement feature 198, a latch door engagement feature 200, and an attachment hoop attachment feature 202. The latch body 194 provides a plurality of tension adjustment members 204 (one shown in cutaway view), an over-center pivot feature 206, and a catch receptacle 208.

In a preferred embodiment, the latch body engagement feature 198 of the latch block 192 is slid into engagement with a selected one of the plurality of tension adjustment members 204. Because the plurality of tension adjustment members 204 extend along a length 210 of the latch body 194, the selection of a specific tension adjustment member 204 determines a holding force imparted by the attachment hoop 108 on the chassis 106, which determines how tightly the inventive detachable sole 100 is secured adjacent a mating ankle and foot covering, such as orthopedic device 218 (of FIG. 6).

The latch door 196 is configured for engagement with the latch block 192 and the latch body 194. The latch body provides a plurality of latch block support channels 212, a latch door catch 214, and a pivot detent 216. Once the selection has been made for the particular tension adjustment member 204, and the latch body engagement feature 198 has been slid onto the selected tension adjustment member 204, a position of the latch block 192 relative to the catch receptacle 208 can be determined. When the relative position of the latch block 192 to the catch receptacle 208 has been determined, a specific latch block support channel 212 is selected by rotating the latch door catch 214 about the pivot detent 216 to engage the latch door engagement feature 200 with the catch receptacle 208. Once positioned, the latch door 196 mitigates a buildup of ice and snow around the interface of the latch body engagement feature 198 and the selected tension adjustment member 204.

Figure 6:
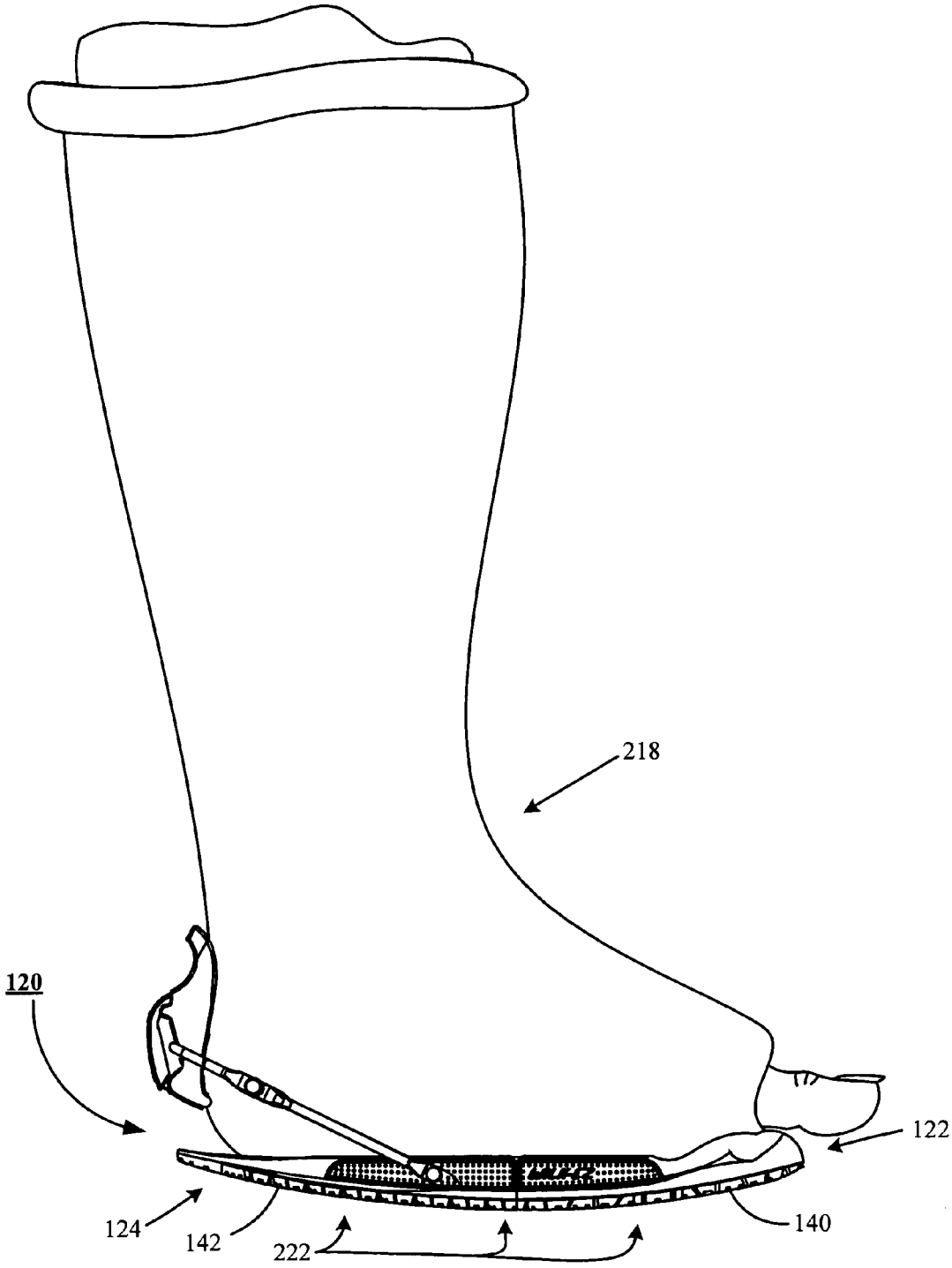
FIG. 6 shows a side elevational view of an alternative embodiment of the inventive detachable sole secure to an ankle and foot covering.
Figure 7:
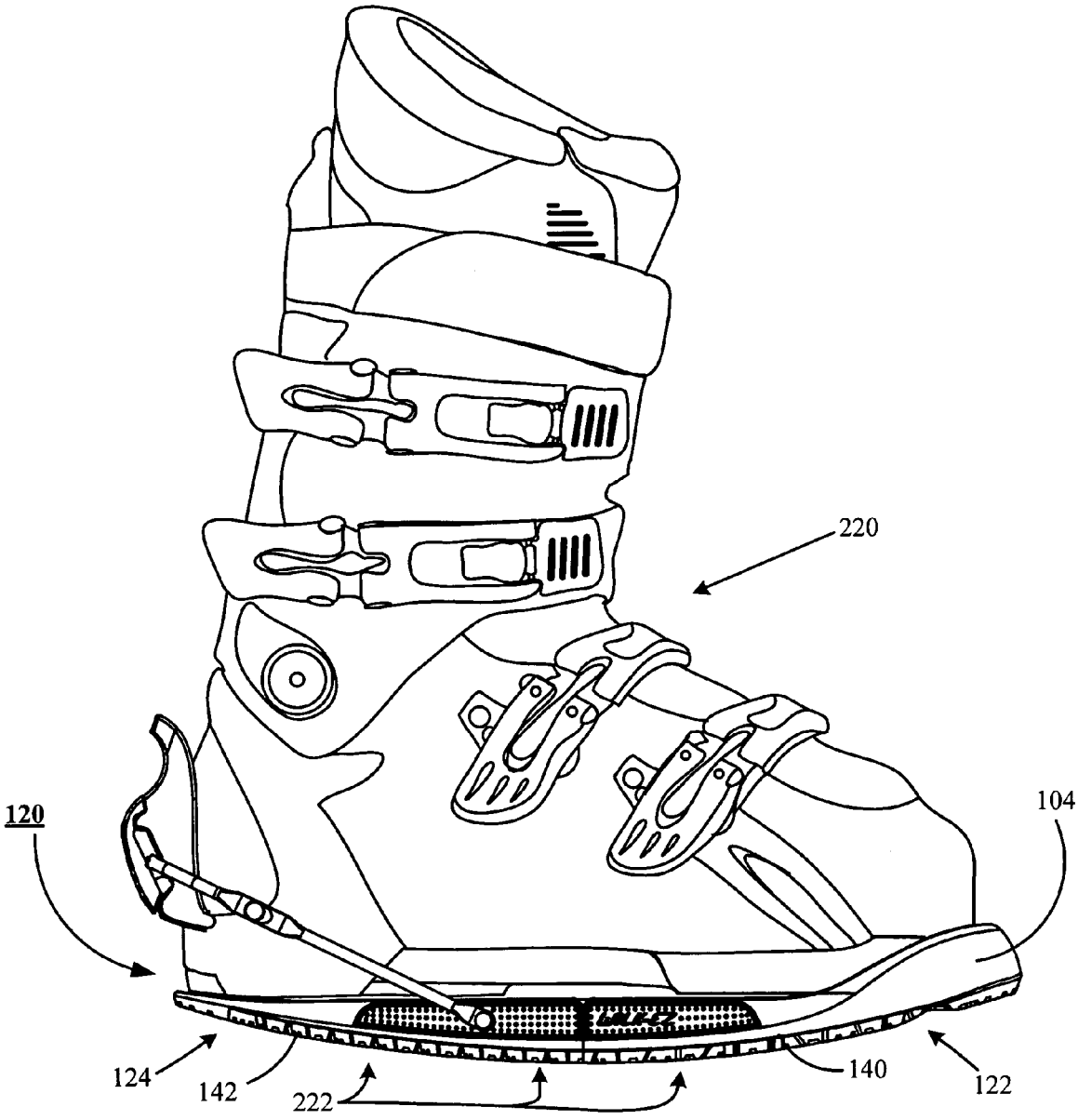
FIG. 7 illustrates a side elevational view of the inventive detachable sole of FIG. 2 secure to an alternate ankle and foot covering.

FIGS. 6 and 7 each show an example of a use for the inventive detachable sole 120. The applied use of the inventive detachable sole 120 depicted by FIG. 6 resides within the medical arts. The inventive detachable sole 120, provides an enhanced walking ability for an individual wearing an orthopedic device such as a cast 218. The enhanced walking ability provided for an individual wearing the cast 218 results from the concave shape 222 of the inventive detachable sole 120, and the preferred tread patterns 140 and 142, respectively of the first sole portion 122 and the second sole portion 124.

The applied use of the inventive detachable sole 120 depicted by FIG. 7 resides within the sports equipment arts. The inventive detachable sole 120, provides an enhanced walking ability for an individual wearing, for example an Alpine type ski boot, such as 220. The enhanced walking ability provided for an individual wearing the ski boot 220 results from the concave shape 222 of the inventive detachable sole 120, the preferred tread patterns 140 and 142, respectively of the first sole portion 122 and the second sole portion 124, the toe confinement portion 104, and the adjustability features of the over-center latch 110.

Figure 8:
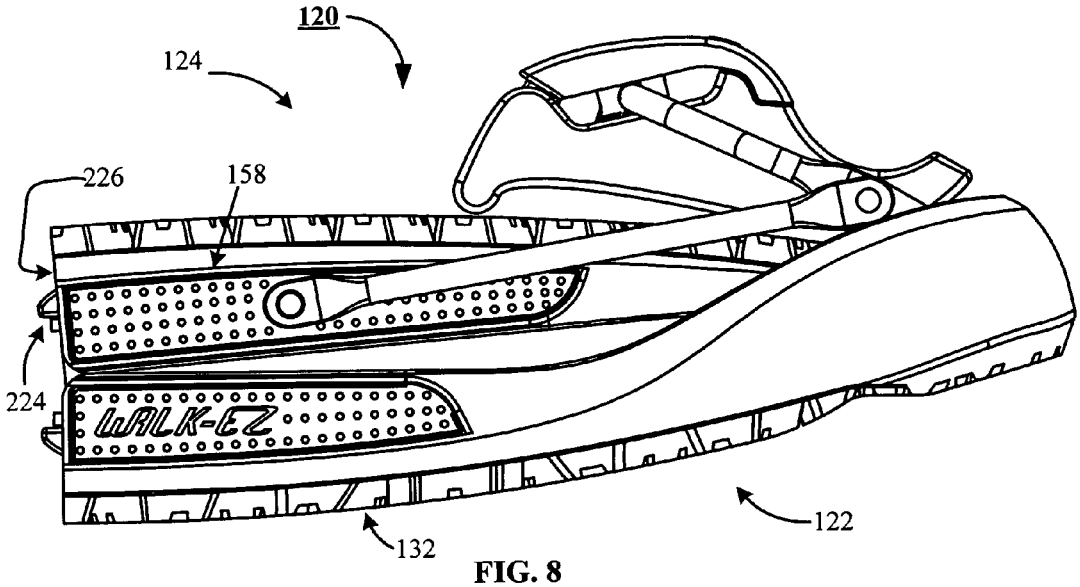
FIG. 8 is a side elevational view of the inventive detachable sole of FIG. 2 shown in a collapsed configuration ready for storage.
Figure 9:
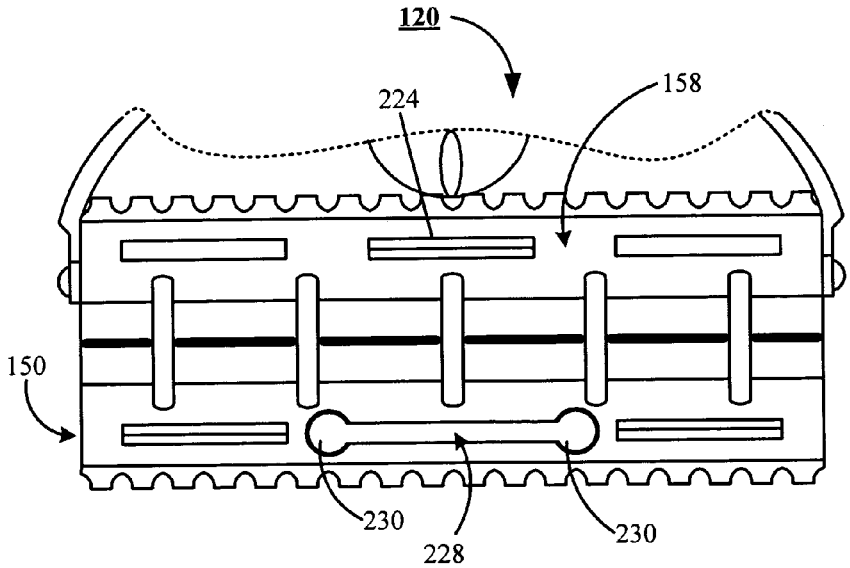
FIG. 9 is a rear elevational view of the inventive detachable sole of FIG. 2 shown in a collapsed configuration ready for storage.

FIG. 8 provides a best view of a chassis stabilization member 224, which extends from the proximal end 226 of the heel chassis portion 158, while FIG. 9 provides a best view of a chassis stabilization aperture 228. The chassis stabilization aperture 228 is configured to accommodate penetration of the chassis stabilization member 224 when the heel chassis portion 158 is folded into alignment with the toe chassis portion 150. FIG. 9 further shows the inclusion of a pair of retention stud apertures 230. The retention stud apertures 230 accommodate penetration of a pair of respective chassis retention studs 232 of FIGS. 10 and 11.

It will be noted that FIG. 8 shows the inventive detachable sole 120 to be in a partially folded position. It will be understood that the depiction of the inventive detachable sole 120 in a partially folded position was provided to enhance an understanding of the present invention and does not impose any limitations on the present invention. In a preferred embodiment, in a fully folded position, the first sole portion 122 aligns with the second sole portion 124 in a substantially flat continuous manner.

Figure 10:
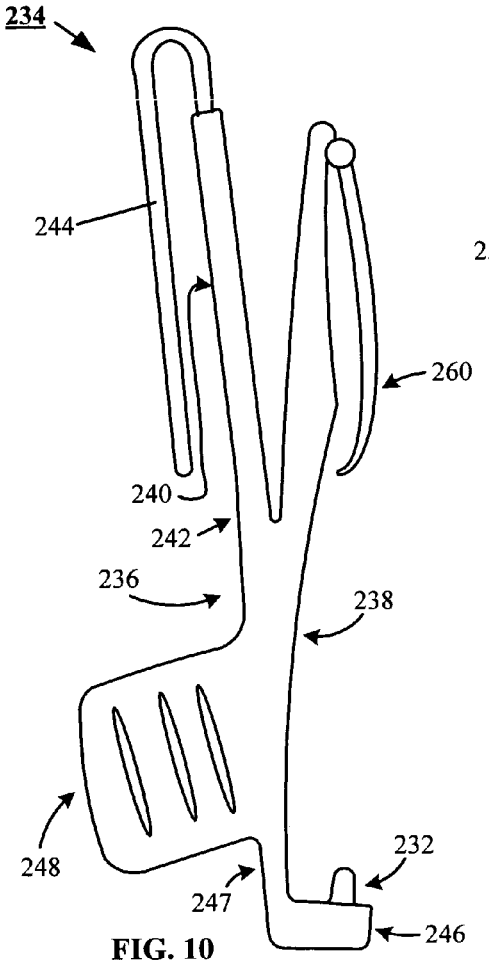
FIG. 10 is a first side elevational view of an inventive detachable sole storage rack configured for interaction with the inventive detachable sole of FIG. 2.
Figure 11:
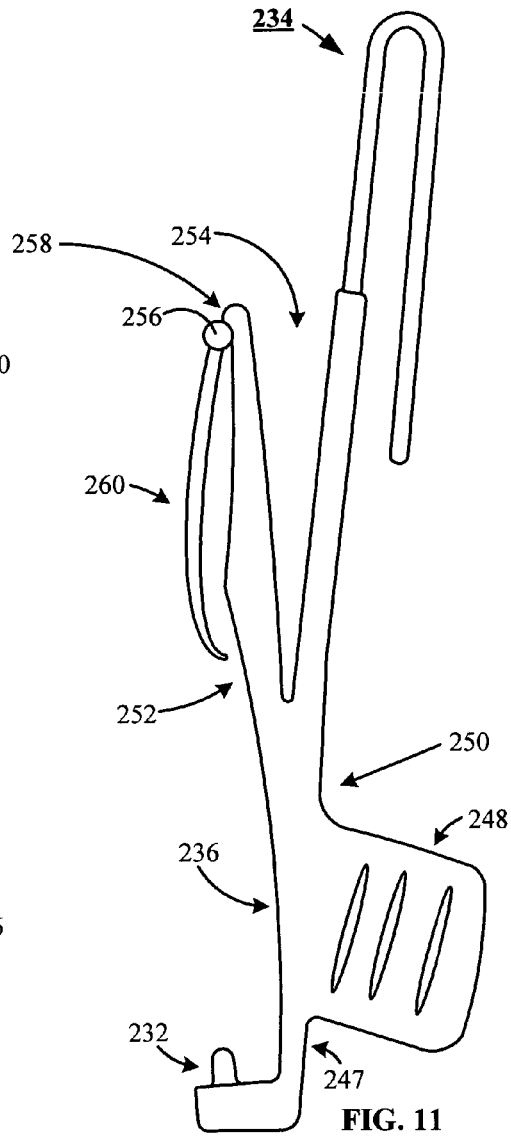
FIG. 11 is a second side elevational view of the inventive detachable sole storage rack of FIG. 10.

Turning to FIGS. 10 and 11, a left side elevational view of a storage rack 234 is provided by FIG. 10, and a right side elevational view of the storage rack 234 is provided by FIG. 11. The storage rack 234 includes a main body portion 236 with a concave surface 238, configured for mating conformance with the toe tread portion 133 (of FIG. 8). A hook adjustment portion 240 projects from a proximal end 242 of the main body portion 236. The hook adjustment portion 240 supports and accommodates a hook attachment member 244. The hook attachment member 244 is useful for attachment of the inventive detachable sole 120 to an ankle and foot covering such as the ski boot 220 of FIG. 7.

In a preferred embodiment, the hook adjustment portion 240 provides for an adjustment, in a vertical direction (as shown by FIG. 11), of the hook attachment member 244 to accommodate varying sizes of ski boots, or orthopedic devices. The storage rack 234 further includes a chassis support shelf 246 extending from a proximal end 247 of the main body portion 236. The chassis support shelf 246 provides a support member for the chassis retention studs 232. The chassis retention studs 232 interact with the retention stud apertures 230 (of FIG. 9) to position the toe tread portion 133 adjacent the main body portion 236. FIG. 11 further shows a main body support 248 extending from a mid-portion 250 of the main body portion 236.

FIG. 11 further shows a strap support member 252 projecting from the proximal end 242 of the main body portion 236. A garment confinement slot 254 is formed between the hook adjustment portion 240 and said strap support member 252. With the inventive detachable sole 120 attached to a ski boot, such as ski boot 220 (of FIG. 7), the garment confinement slot 254 accommodates placement of a garment portion, such as a pant leg of the pair of ski pants (not shown). To secure the inventive detachable sole 120 to the ski boot 220 (as shown in FIG. 7), a strap pin 256 is attached to a distal end 258 of the strap support member 252, and a strap 260 attached to the strap pin 256. The strap 260 interacts with the over-center latch 110 to confine the toe tread portion 133 adjacent the main body portion 236.

Figure 12:
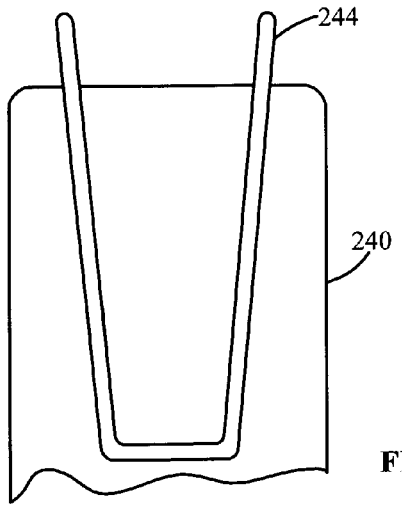
FIG. 12 is a partial cutaway rear elevational view of the inventive detachable sole storage rack of FIG. 10.

FIG. 12 is provided to enhance an understanding of a preferred configuration of the hook attachment member 244 relative to the hook adjustment portion 240. In a preferred embodiment the hook attachment member 244 is formed from stainless spring steel, however those skilled in the art will understand that alternate materials and configurations may provide substitute design choices for the hook attachment member 244, and still remain within the scope and spirit of the present intention.

Figure 13:
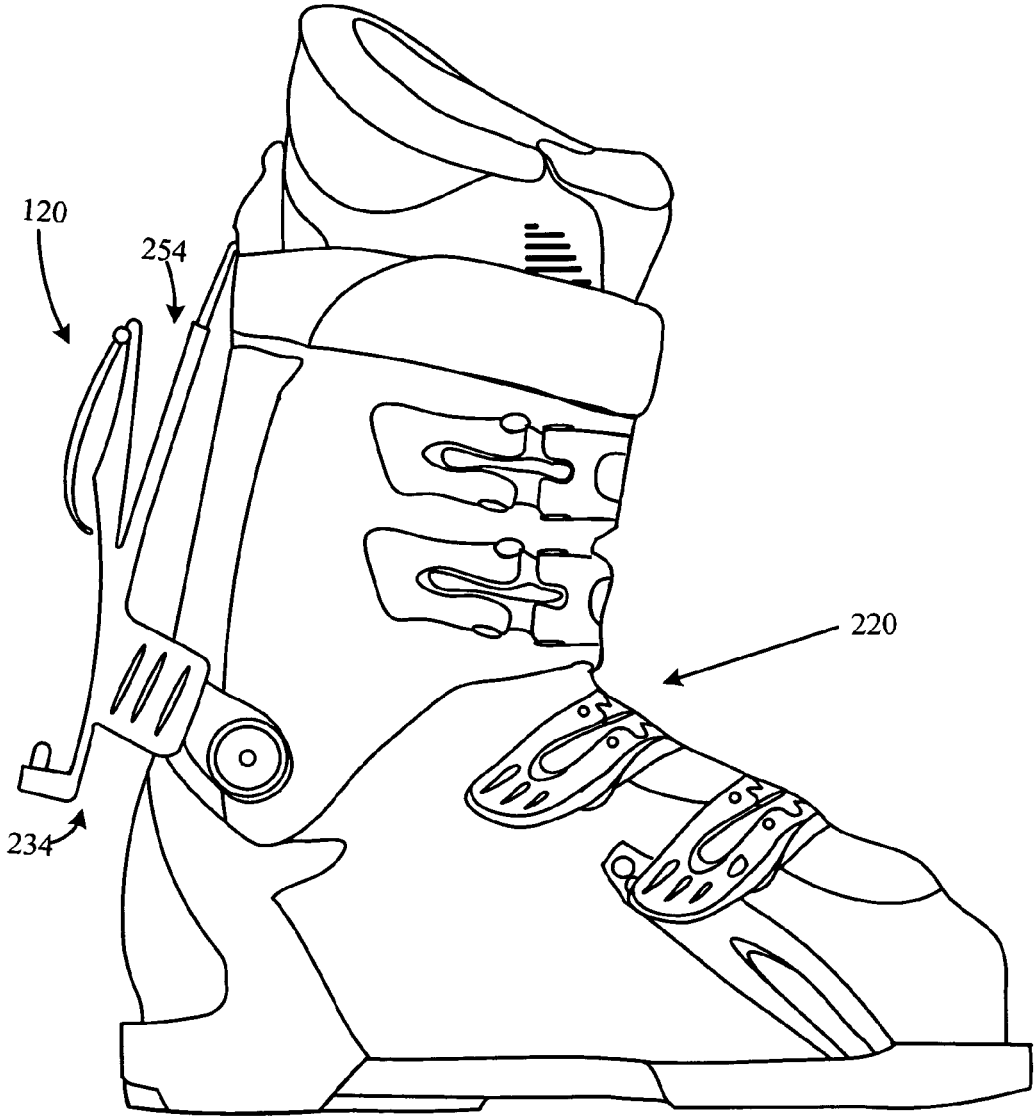
FIG. 13 is a side elevational view of the inventive detachable sole storage rack of FIG. 10 attached to the alternate ankle and foot covering of FIG. 7.
Figure 14:
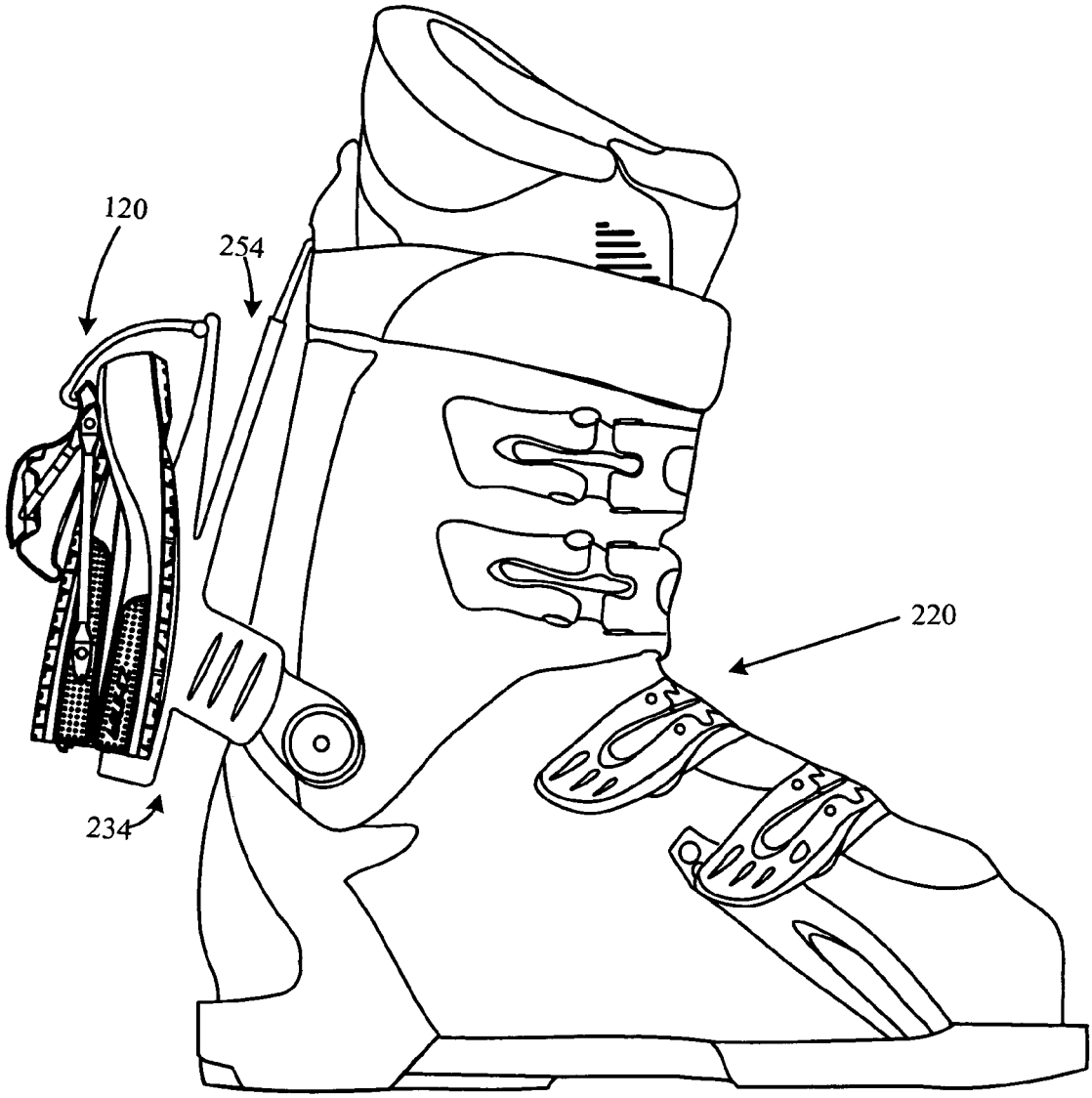
FIG. 14 is a side elevational view of the inventive combination of the present invention.

FIG. 13 provides an elevational view of a preferred embodiment configuration of the storage rack 234 attached to ski boot 220, while FIG. 14 serves to shows the configuration of FIG. 13 with the addition of the inventive detachable sole 120 of the present invention. By viewing FIG. 14 it will be noted that the storage rack 234, when attached to the ski boot 220, provides for convenient storage of the inventive detachable sole 120, when the inventive detachable sole 120 is detached from the ski boot 220, for example during periods of time in which an individual is engaged in skiing down a slope.

Figure 15:
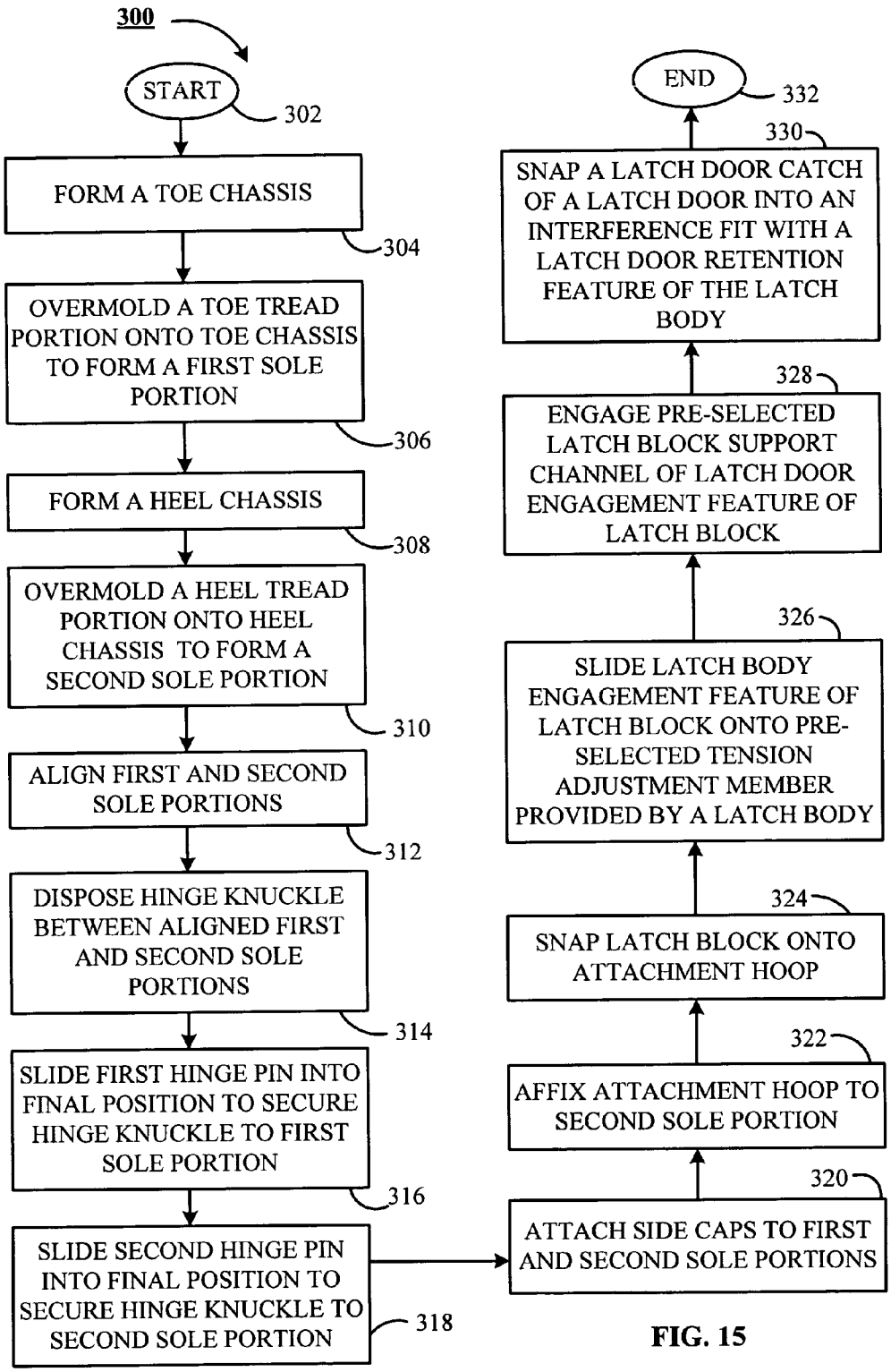
FIG. 15 is a flow diagram of the method of making the inventive detachable sole of FIG. 2.

Flowchart 300 of FIG. 15 shows method steps of a process of making an inventive detachable sole (such as 120). The process commences at start step 302 and continues at process step 304. At process step 304, a toe chassis portion (such as 150) is formed, and at process step 306 a toe tread portion (such as 133) is overmolded onto the toe chassis. At process step 308, a heel chassis (such as 158) is formed and at process step 310 a heel tread portion (such as 134) is overmolded onto the heel chassis.

At process step 312, a first sole portion (such as 122) is aligned to a second sole portion (such as 124). With the first and second sole portions aligned, at process step 314, a process of installing a hinge portion (such as 126) is commenced by disposing each of a plurality of hinge knuckles (such as 176) within corresponding knuckle reception cavities (such as 186). At process step 316, a first of a pair of hinge pins (such as 178) is slid into its final position to secure the hinge knuckle to the first sole portion, and at process step 318 the second of the pair of hinge pins is slid into position to secure the hinge knuckle to the second sole portion.

At process step 320, side caps (such as 136, 138, 172, and 174) are attached to each of the first and second sole portions. The attachment of the side caps mitigates encroachment of debris from migrating into each of the plurality of cavities (such as 170), which collectively form baffling members of a baffled support matrix (such as 144). At process step 322, an attachment hoop (such as 128) is attached to the second sole portion, and at process step 324 a latch block (such as 192) is snapped onto the attachment hoop.

At process step 326, a latch body engagement feature (such as 198), is slid onto a pre-selected tension adjustment member (such as 204), provided by a latch body (such as 194). At process step 328, a pre-selected latch body support channel (such as 212) of a latch door (such as 196) engages a latch door engagement feature (such as 200) of the latch block. At process step 330, a latch door catch (such as 214) is snapped into an interference fit with a catch receptacle (such as 208) of the latch body, and the process concludes at end process step 332.

Figure 16:
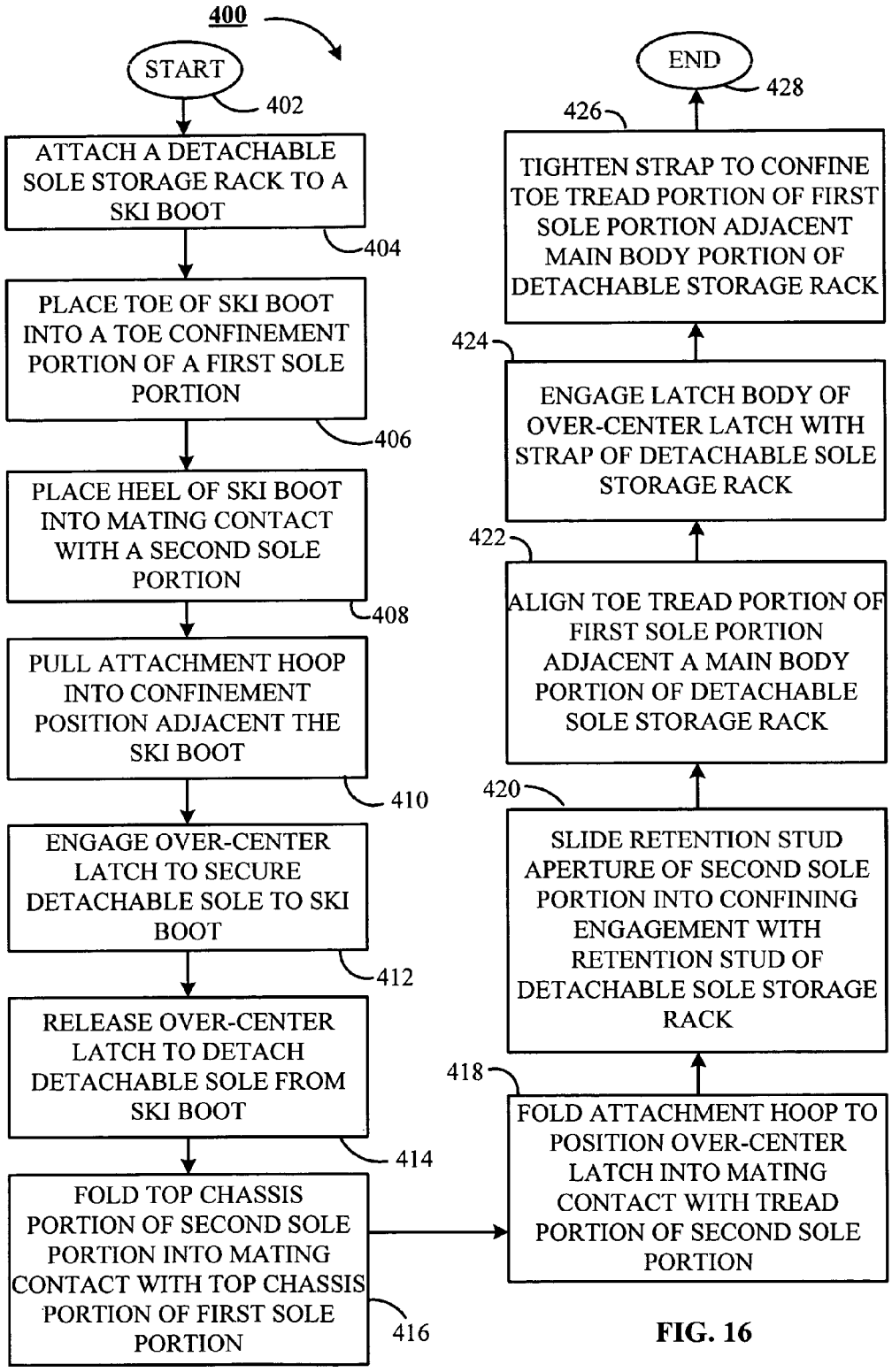
FIG. 16 is flow diagram of a method of using the inventive combination of FIG. 14.

Flowchart 400 of FIG. 16 shows method steps of a process of using an inventive detachable sole (such as 120). The process commences at start step 402 and continues at process step 404. At process step 404, a detachable sole storage rack (such as 234), is attached to a ski boot (such as 220). At process step 406, a toe of a ski boot is placed into a toe confinement portion (such as 104) of a first sole portion (such as 122). At process 408, a heel of the ski boot is placed in mating contact with a second sole portion (such as 124). At process step 410, an attachment hoop (such as 128) is pulled into a confinement position adjacent the ski boot, and at process step 412 an over-center latch (such as 110) is engaged to secure the detachable sole to the ski boot.

At process step 414, the over-center latch is released to detach the detachable sole from the ski boot. At process step 416, a top chassis portion (such as 162) of the second sole portion is folded into mating contact with a top chassis portion (such as 154) of the first sole portion. At process step 418, the attachment hoop is folded to position the over-center latch into mating contact with a heel tread portion (such as 134) of the second sole portion. At process step 420, a pair of retention stud apertures (such as 230), are slid into confining engagement with a pair of chassis retention studs (such as 232). At process step 422, a toe tread portion (such as 133) of the first sole portion is aligned adjacent a main body portion (such as 236) of the detachable sole storage rack.

A latch body (such as 194) of the over-center latch is lashed with a strap (such as 260) to the detachable storage rack at process step 424. At process step 426, the strap is tightened to confine the toe tread portion of the first sole portion adjacent the main body portion of the detachable storage rack and the process concludes at end process step 428.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A combination comprising a detachable sole configured for attachment to and detachment from an ankle and foot covering, wherein said detachable sole comprises a chassis that includes a baffled support matrix interposed between top and bottom chassis portions and in which said chassis comprises a hinge interposed between a heel chassis portion and a toe chassis portion, in which said heel and toe chassis portions each comprise baffled support matrices interposed between top and bottom chassis portions, and in which said detachable sole further comprises an attachment hoop communication with said heel chassis portion of said chassis and a latch attached to said attachment hoop, wherein upon positioning said latch adjacent a latch region of said ankle and foot covering, and latching said latch, said detachable sole is attached to said ankle and foot covering, and wherein the hinge comprises a hinge knuckle providing a pair of hinge pin apertures, and a pair of hinge pins configured for sliding engagement with said hinge pin apertures.

2. The combination of claim 1, further comprises said ankle and foot covering, in which said ankle and foot covering substantially immobilizes an ankle supporting said ankle and foot covering.

3. The combination of claim 2, in which said ankle and foot covering comprises an orthopedic device.

4. The combination of claim 2, in which said ankle and foot covering comprises a ski boot.

5. The combination of claim 1, in which each said heel and toe chassis portions further comprise:

a plurality of hinge pin confinement portions provided on a proximal end, wherein each hinge pin confinement portion provides a passageway configured for alignment with a hinge pin aperture of the pair of hinge pin apertures and sized to accommodate hinge pin passage;

a hinge knuckle reception cavity interposed adjacent hinge pin confinement portions; and a plurality of overmold interface cavities provided on a distal end, wherein when said hinge knuckle is disposed within respective hinge cavities of said heel and toe chassis portions, and said respective hinge pins are passed though respective hinge pin apertures and into adjacency with said respective passageways, said heel and toe chassis portions form said chassis.

6. The combination of claim 5, in which said detachable sole further comprises:

a heel tread portion attached to said heel chassis portion of said chassis, wherein said heel tread portion interacts with said respective overmold interface cavities to enhance the attachment of said heel tread portion to said heel chassis portion; and a toe tread portion attached to said toe chassis portion of said chassis, wherein said toe tread portion interacts with said respective overmold interface cavities to enhance the attachment of said toe tread portion to said toe portion, wherein said heel and toe tread portions provide enhanced traction during use of said detachable sole.

7. The combination of claim 1, further comprising:

a latch pin interacting with said attachment hoop and said heel chassis portion of said chassis to secure said attachment hoop to said heel chassis portion; and a latch pin mounting aperture provided by said heel chassis portion of said chassis, wherein said latch pin mounting aperture provides an inner diameter configured to provide an interference fit between said latch pin and said mounting aperture when said latch pin engages said inner diameter.

8. The combination of claim 7, in which said latch comprises:

a latch block attached to said attachment hoop, said latch block providing a latch body engagement feature and a latch door engagement feature;

a latch body configured for engagement with said latch block, in which said latch body provides a plurality of tension adjustment members, and wherein a selection of a specific tension adjustment member for engagement with said latch body engagement feature determines a holding force of said chassis adjacent said ankle and foot covering; and a latch door configured for engagement with said latch body and said latch block, in which said latch door provides a plurality of latch block support channels and a latch door catch configured for mating attachment to said latch body to confine said latch door adjacent said latch body, and wherein selection of a specific latch block support channel corresponding to said selected tension adjustment member maintains said latch door in proper alignment with said latch body.

9. The combination of claim 8, further comprising a side cap configured for attachment to said chassis, wherein upon attachment of said side cap to said chassis, debris is substantially precluded from entering said baffled support matrix.

10. The combination of claim 9, further comprising a storage rack configured for attachment to said ankle and foot covering and for supporting said detachable sole when said storage rack is attached to said ankle and foot covering and said detachable sole is detached from said ankle and foot covering.

11. The combination of claim 10, in which said storage rack comprises:

a main body portion configured for mating conformance with said toe tread portion of said toe chassis portion;

a hook adjustment portion projecting from a proximal end of said main body portion;

an attachment member confined by said hook adjustment portion and positionably adjustable relative to said hook adjustment member;

a chassis support shelf projecting from a distal end of said main body portion;

a chassis retention stud extending from said chassis support shelf, said stud interacting with said toe chassis portion to position said toe tread portion adjacent said main body portion;

a main body support extending from a mid-portion of said main body portion;

a strap support member projecting from said proximal end of said main body portion, and wherein a garment confinement slot is formed between said hook adjustment portion and said strap support member;

a strap pin attached on a distal end of said strap support member; and a strap attached to said strap pin, said strap interacting with said latch body to confine said toe tread portion adjacent said main body portion.

12. The combination of claim 11, in which said top chassis portions of said toe and heel chassis portions are continuous portions.

13. The combination of claim 12, in which said hinge interposed between said toe and heel chassis portions facilitates placement of said continuous top chassis portion of said toe chassis portion adjacent said continuous top chassis portion of said heel chassis portion, and wherein said attachment hoop comprises a latch attachment portion hinged to a heel chassis attachment portion.

14. The combination of claim 13, in which said heel chassis portion further comprises a chassis stabilization member extending from said proximal end of said heel chassis portion, said toe chassis portion further comprises a chassis stabilization aperture and a retention stud aperture, wherein said chassis stabilization aperture accommodates penetration of said chassis stabilization member when said proximal end of said heel chassis portion is positioned in mating contact with said proximal end of said toe chassis portion, and further wherein said retention stud aperture accommodates penetration of said chassis retention stud when said detachable sole is detached from said ankle and foot covering and attached to said storage rack.

15. The combination of claim 14, in which said ankle and foot covering comprises a ski boot.

16. A method by steps comprising:

attaching a detachable sole storage rack to a ski boot;

placing a toe of said ski boot into a toe confinement portion of a first sole portion;

positioning a heel of the ski boot into mating contact with a second sole portion;

pulling an attachment hoop into a confinement position adjacent said ski boot;

engaging an over-center latch to secure said detachable sole to said ski boot;

releasing said over-center latch to detach said detachable sole from said ski boot;

folding a top chassis portion of said second sole portion into mating contact with a top chassis portion of said first sole portion;

articulating said attachment hoop to position said over-center latch into mating contact with said tread portion of said second sole portion;

sliding a retention stud aperture of said second sole portion into confining engagement with a retention stud of said detachable sole storage rack;

aligning a toe tread portion of said first sole portion adjacent a main body portion of said detachable sole storage rack;

engaging a latch body of said over-center latch with a strap of said detachable sole storage rack; and tightening said strap to confine said toe tread portion of said first sole portion adjacent said main body portion of said detachable sole storage rack to form a combination ski boot with attached detachable sole storage rack storing the detachable sole.

* * * * *